US007230381B2

(12) United States Patent
Ohkubo et al.

(10) Patent No.: US 7,230,381 B2
(45) Date of Patent: Jun. 12, 2007

(54) METHOD OF MANUFACTURING A PLASMA DISPLAY PANEL

(75) Inventors: Tatsuya Ohkubo, Kawasaki (JP); Yoshimi Shirakawa, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 68 days.

(21) Appl. No.: 11/175,199

(22) Filed: Jul. 7, 2005

(65) Prior Publication Data

US 2005/0245166 A1 Nov. 3, 2005

Related U.S. Application Data

(62) Division of application No. 10/637,518, filed on Aug. 11, 2003, now Pat. No. 7,008,284.

(30) Foreign Application Priority Data

Aug. 30, 2002 (JP) ..... 2002-255100

(51) Int. Cl.
*H01J 17/49* (2006.01)
*H01J 9/00* (2006.01)

(52) U.S. Cl. ..... 313/587; 313/586; 313/583; 313/582; 445/24; 445/25

(58) Field of Classification Search ..... 313/582–587; 445/24, 25
See application file for complete search history.

(56) References Cited

U.S. PATENT DOCUMENTS 3,767,282 A 10/1973 Poley et al. ..... 445/25
5,977,708 A 11/1999 Amatsu et al. ..... 313/586
6,159,066 A 12/2000 Amatsu et al. ..... 445/24
6,184,621 B1 2/2001 Horiuchi et al. ..... 445/24
6,373,190 B1 4/2002 Tsuruoka et al. ..... 313/586
6,621,217 B2 * 9/2003 Nishiki et al. ..... 313/587
7,019,461 B2 * 3/2006 Harada ..... 313/586

(Continued)

FOREIGN PATENT DOCUMENTS

EP 1 361 595 11/2003

(Continued)

OTHER PUBLICATIONS

English language Abstract of Japanese Publication No. 2000100327 dated Apr. 7, 2000.

(Continued)

*Primary Examiner*—Mariceli Santiago
(74) *Attorney, Agent, or Firm*—Staas & Halsey LLP

(57) ABSTRACT

A method of manufacturing a panel assembly is used for making a plasma display panel having electrodes and ribs formed on a substrate. The method includes the steps of forming the electrodes on the substrate so that these electrodes are extended to a periphery of the substrate to form their terminals, applying a terminal protective paste on the terminals for protecting the terminals, applying a rib paste on the entire area of a rib formation region provided on the substrate, molding the rib paste by use of a stamping die having cavities in the form of rib shape into green ribs, and firing the terminal protective paste and the green ribs simultaneously to form a terminal protective layer and ribs on the substrate.

9 Claims, 6 Drawing Sheets

U.S. PATENT DOCUMENTS

2004/0239246 A1 12/2004 Asida et al. ..... 445/24

FOREIGN PATENT DOCUMENTS

| | | | | |
|---|---|---|---|---|
| EP | 1 408 527 | | | 4/2004 |
| JP | 54092170 | A | * | 7/1979 |
| JP | 07065729 | A | * | 3/1995 |
| JP | 08293253 | A | * | 11/1996 |
| JP | 08304790 | A | * | 11/1996 |
| JP | 10040819 | A | | 2/1998 |
| JP | 11183884 | A | * | 7/1999 |
| JP | 2000-21303 | | | 1/2000 |
| JP | 2000100327 | A | | 4/2000 |
| JP | 2001143609 | A | | 5/2001 |
| JP | 2001166284 | A | * | 6/2001 |

OTHER PUBLICATIONS

English language Abstract of Japanese Publication No. 2000021303 dated Jan. 21, 2000.

* cited by examiner

METHOD OF MANUFACTURING A PLASMA DISPLAY PANEL

CROSS-REFERENCE TO RELATED APPLICATION

This application is a divisional of application No. Ser. 10/637,518, filed Aug. 11, 2003 now U.S. Pat. No. 7,008,284 issued Mar. 7, 2003.

This application is related to Japanese Patent Application No. 2002-255100 filed on Aug. 30, 2002, whose priority is claimed under 35 USC § 119, the disclosure of which is incorporated by reference in its entirety.

BACKGROUND OF THE INVENTION

1. Field of the Invention

The present invention relates to a method of manufacturing a plasma display panel, and more particularly to a method of manufacturing a substrate with ribs for a plasma display panel.

2. Description of the Related Art

In general, ribs (also referred to as "barrier ribs") for partitioning a discharge space of a conventional plasma display panel (hereinafter, PDP) are formed by a sandblasting method. The sandblasting method is performed as follows. On a substrate (for example, a rear substrate) on which electrodes and a dielectric layer to cover the electrodes for protecting them from the sandblasting are formed, a rib paste is applied to have a predetermined thickness and dried, thereby forming a rib material layer. Subsequently, a photosensitive dry film resist is applied on the rib material layer and then exposed to light and developed into a desired rib pattern, thereby forming a mask of the dry film resist. An abrasive is blasted onto the rib material layer via the mask of the dry film resist to remove a portion of the rib material layer exposed from the mask, thereby patterning the rib material layer into a predetermined shape. Thereafter, the mask is exfoliated by caustic soda and the resulting substrate is fired to burn out a synthetic resin contained in the rib material layer, thereby forming ribs.

However, a great number of steps are needed for forming the ribs by the sandblasting method as described above. In addition, the rib material layer thus formed is cut and discarded by more than half, so that use efficiency of the material layer is decreased and rib production costs are remarkably increased.

Japanese Unexamined Patent Publication No. 2000-21303 discloses an improved method of forming ribs on a rear substrate for a conventional PDP. This rib formation method is a transfer method for the formation of ribs in which the ribs are formed by molding a rib paste layer (rib material layer) using a mold. The transfer method includes the following steps. On a surface of a rear substrate 102 on which electrodes 121 are previously arranged (see FIG. 6(A)), a rib paste 123 is applied which contains a thermosetting or a UV-cured organic binder but does not contain a volatile solvent, to form a rib paste layer (see FIG. 6(B)). Then, air between the mold 124 and the rib paste layer 123 is expelled by degassing while a thin plate elastic mold 124 with cavities corresponding to a predetermined shape of the ribs is pressed against the rib paste layer 123 in order to improve adhesion therebetween (see FIG. 6(C)). Thereafter, the rib paste layer 123 is cured by heat or ultraviolet irradiation while pressing the mold against the layer 123 with a predetermined pressure via a cushion material 125 in order to mold ribs (green ribs) 123*a*, thereby integrally sticking the ribs 123*a* thus molded to the rear substrate 102 (see FIG. 6(D)), generating strength enough to resist releasing force. As a result, it is possible to surely mold on the rear substrate the ribs (green ribs) 123*a* having no defects of air bubbles and having a high level of height accuracy (see FIG. 6(E)). In this rib formation method, a dielectric layer covering the electrodes is formed along with the ribs.

In the conventional PDP, as described above, the dielectric layer is provided on the rear substrate after the formation of electrodes and before the formation of ribs. In such a conventional PDP, leads and terminals of the electrodes not covered with the dielectric layer are exposed. Therefore, during firing of the rib paste (green rib) and a phosphor paste and during fusing with a sealing material, the exposed portion of the terminals and leads is thermal-oxdized, which will cease conduction. One measure to solve such a problem may be to form a terminal protective layer by applying the rib paste on the leads and terminals at the formation of ribs. This measure, however, has a disadvantage that adhesion of the rib paste to the electrodes is not good. That is, because a firing temperature of the rib paste (green rib) is equal to or less than a softening temperature of glass contained in the rib paste, and for this reason, even if the rib paste (green rib) is fired, a glass material contained in the rib paste does not melt enough to flow liquidly, so that a gap is liable to occur at an interface between the electrodes and the rib paste. Thus, there is a problem that a leak (of discharge gas) may be caused by the gap at a periphery portion of panel assemblies sealed with the sealing material.

Further, it is necessary to perform etching of a portion of the terminal protective layer applied on a terminal portion after the assembly of a panel. However, since the rib paste contains a large amount of filler such as an alumina filler, the paste is hardly dissolved in acid such as nitric acid and it is difficult to etch away the portion of the terminal protective layer, which is problematic for the conventional PDP.

SUMMARY OF THE INVENTION

The present invention has been achieved to solve the above problems. An object of the present invention is to provide a method of manufacturing a PDP in which a dielectric layer covering the entire surface of a substrate need not be provided, thermal oxidation of terminals is not caused by firing of a rib paste (green rib), no gaps are formed at an interface between each electrode and the a rib paste during the firing of the rib paste, and a portion of a terminal protective layer can be etched away by use of acid such as nitric acid.

The present invention provides a method of manufacturing a panel assembly for a PDP having electrodes and ribs formed on a substrate. The method comprises forming the electrodes on the substrate so that these electrodes are extended to a periphery of the substrate to form their terminals; applying a terminal protective paste on the terminals for protecting the terminals; applying a rib paste on the entire area of a rib formation region provided on the substrate to form a rib paste layer; molding the rib paste layer by use of a stamping die having cavities in the form of rib shape into green ribs; and firing the terminal protective paste and green ribs simultaneously to form a terminal protective layer and ribs on the substrate. Accordingly, after at least the terminals of electrodes are covered by applying the terminal protective paste thereon and a display region (also referred to as the rib formation region) is fully covered by applying the rib paste thereon, in short, after the electrodes and terminals are evenly covered with the terminal protective paste and rib paste, both of the pastes are fired simultaneously. Thus, the terminal protective paste covers portions of the electrodes which are not covered with the rib paste, and that is, both of the rib paste and terminal protective paste cover all the portions of the electrodes. Therefore, the electrodes and terminals can be sintered without causing thermal oxidization thereof while the rib paste and a phosphor paste are fired and the periphery of panel assemblies is sealed. Also, the time required for forming the terminal protective paste and rib paste can be reduced.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Figure 1:
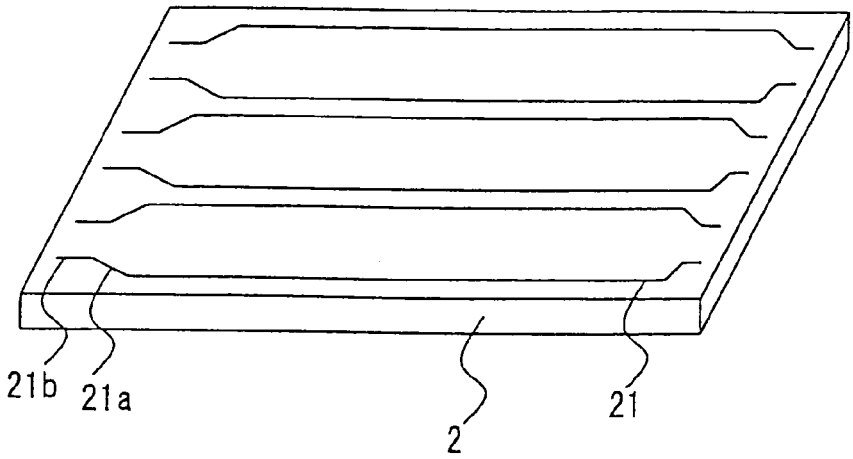
FIGS. 1(A) and 1(B) are views for illustrating the states of a substrate with ribs after the steps of manufacturing a PDP according to a first embodiment of the present invention.
Figure 1:
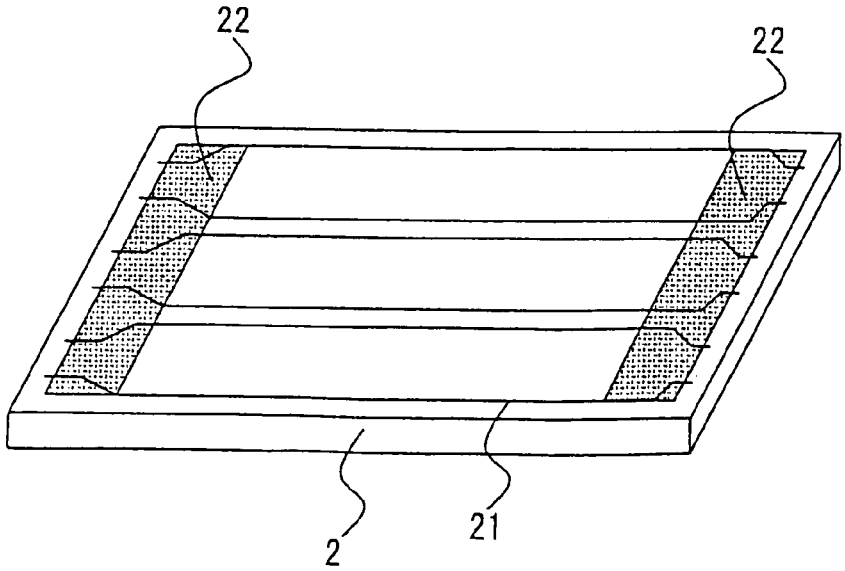

In the method of the present invention, the application of the rib paste may be carried out so that the ends of the rib paste overlap with those of the terminal protective paste, if necessary. The overlapping area may serve as a seal formation region for forming a sealing material at the periphery of the substrate. Accordingly, the terminals arranged in the seal formation region are covered with the terminal protective paste, which provides a good adhesion between the electrodes (including the terminals) and the terminal protective layer although gaps may be formed due to a poor adhesion of the rib paste used for dividing a discharge space to the electrodes. For this reason, no gaps will be formed therebetween. Therefore, it is possible to manufacture the PDP in which a leak hardly occurs after the periphery of the panel assemblies is sealed with the sealing material.

Further, in the method of the present invention, each of the terminal protective paste and rib paste may contain glass as required. The glass contained in the terminal protective paste may be lower in softening temperature than the glass contained in the rib paste. Accordingly, the rib paste is sintered at the simultaneous firing of the terminal protective paste and rib paste, and the protective paste having a lower softening temperature of glass is softened. Accordingly, the adhesion of the protective paste to the electrodes is increased more and thereby the formation of gaps hardly occurs between the terminal protective layer and the electrodes. Therefore, it is possible to manufacture the PDP in which almost no leak occurs after the periphery of the panel assemblies is sealed with the sealing material.

Further, in the method of the present invention, the terminal protective paste may contain a photo-cure binder. Accordingly, there is no need to dry the terminal protective paste after the application thereof and to lower a substrate temperature raised by the drying, as required in a thermosetting binder. Therefore, the formation of ribs can be smoothly performed.

Still further, in the method of the present invention, each of the terminal protective paste and the rib paste may contain the photo-cure binder. The photo-cure binder can make use of photosensitive prepolymers such as polyesteracrylate and urethaneacrylate. Accordingly, there is no need to dry the terminal protective paste after the application thereof and to lower the substrate temperature raised by the drying, as required in the thermosetting binder. The terminal protective paste and rib paste can be simultaneously irradiated with light, thereby making it possible to cure both of the pastes efficiently. Further, since the terminal protective paste and rib paste can be cured at room temperature and the dimensional increase of the substrate can be avoided, the formation of ribs can be smoothly performed.

Still further, in the method of the present invention, the applied terminal protective paste may be thicker than the applied rib paste. Accordingly, a portion of the terminal protective layer covering more than half of a terminal portion can be etched away during the etching for exposing the terminals, and further a portion of the dielectric layer along with the terminal protective layer can easily be removed away without performing any particular processes on the dielectric layer. When the glass contained in the terminal protective paste is lower in softening temperature than that contained in the rib paste, the rib paste is melted into the protective paste and then solidified during the firing, so that the adhesion between the terminal protective layer and the dielectric layer will be increased. This allows remarkably easy etching of the layers.

Also, the present invention provides a method of manufacturing a plasma display panel comprising: using the panel assembly manufactured by the above method as a rear panel assembly; arranging the rear panel assembly opposite to a front panel assembly so that the terminals of the electrodes are exposed at the ends of the rear panel assembly; sealing together the peripheries of the front and rear panel assemblies using the sealing material; and removing the terminal protective layer by etching after the sealing. Accordingly, the terminals can be protected by the terminal protective layer during the sealing. Also, the terminal protective layer can easily be etched by use of acid for exposing the terminals since the terminal protective layer does not contain a large amount of substances which are hardly dissolved in acid and thus is different from the rib paste in which the amount of such substances is small. Further, when the softening temperature of the terminal protective paste is lower than that of the rib paste, the rib paste is melted into the protective paste and then solidified during the firing, so that the adhesion between the terminal protective layer and a dielectric layer which is made of the rib paste will be increased. As a result, an area of two-layer structure consisting of the terminal protective layer and the dielectric layer can be etched more easily.

A First Embodiment of the Present Invention

Figure 2:
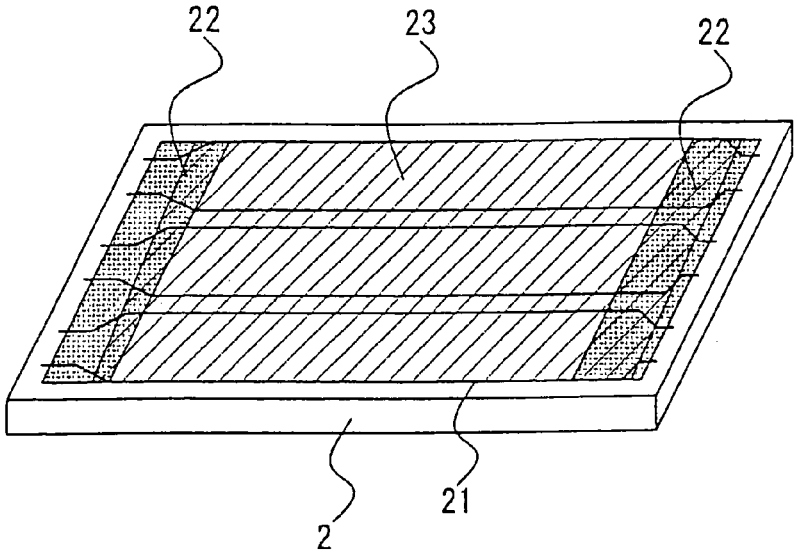
FIGS. 2(A) and 2(B) are views for illustrating the states of the substrate with the ribs after the steps of manufacturing the PDP according to the first embodiment of the present invention.
Figure 2:
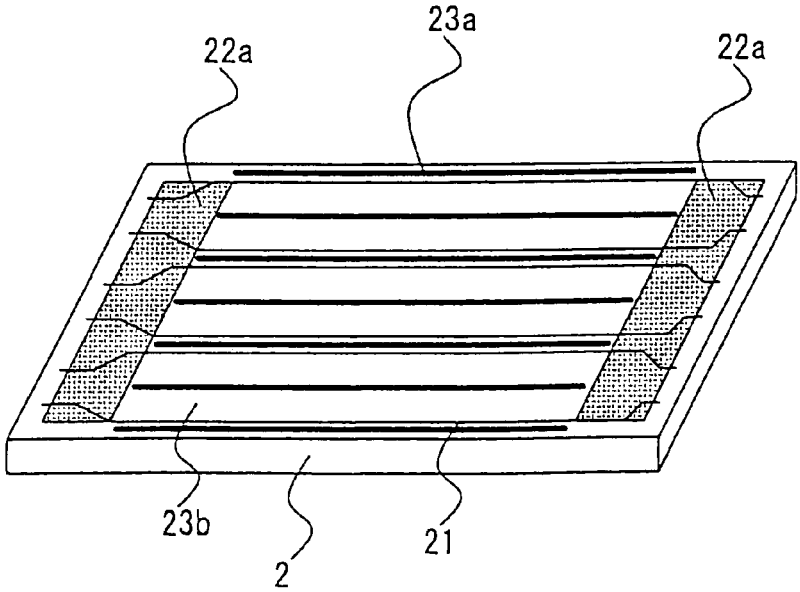
Figure 3:
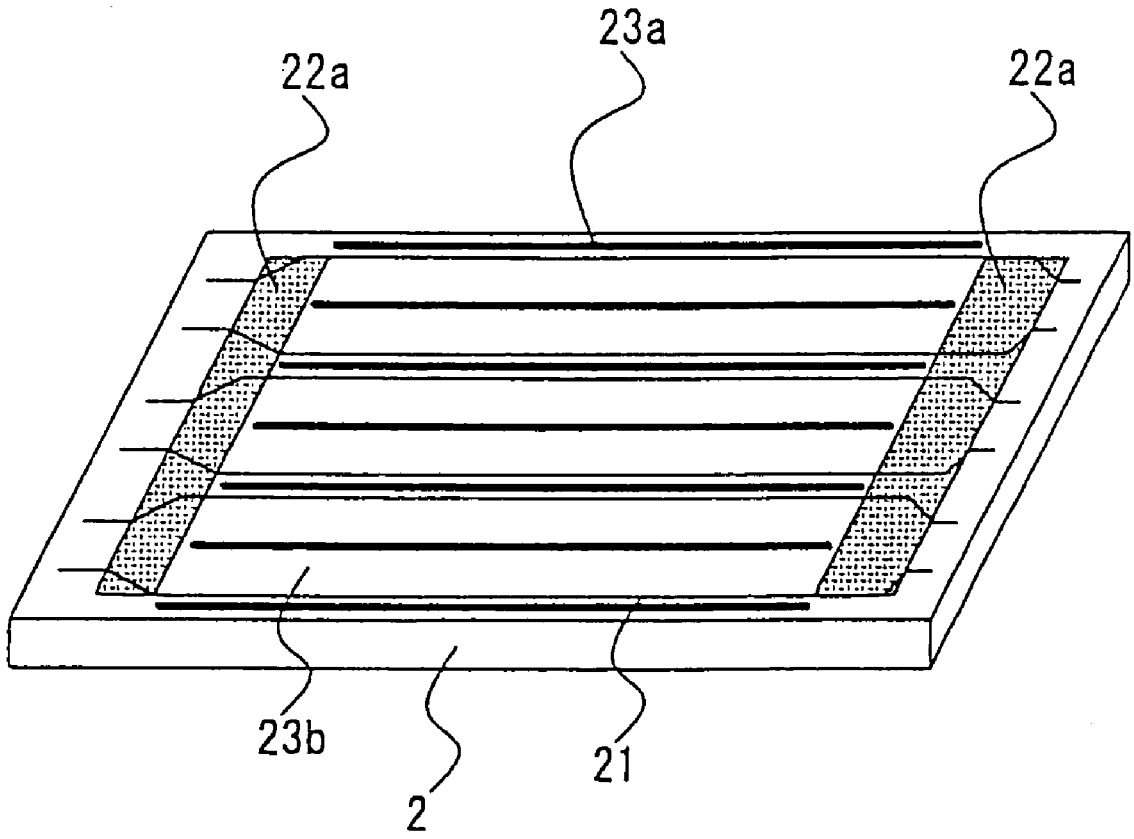
FIG. 3 is a view for illustrating the state of the substrate with the ribs after the steps of manufacturing the PDP according to the first embodiment of the present invention.
Figure 4:
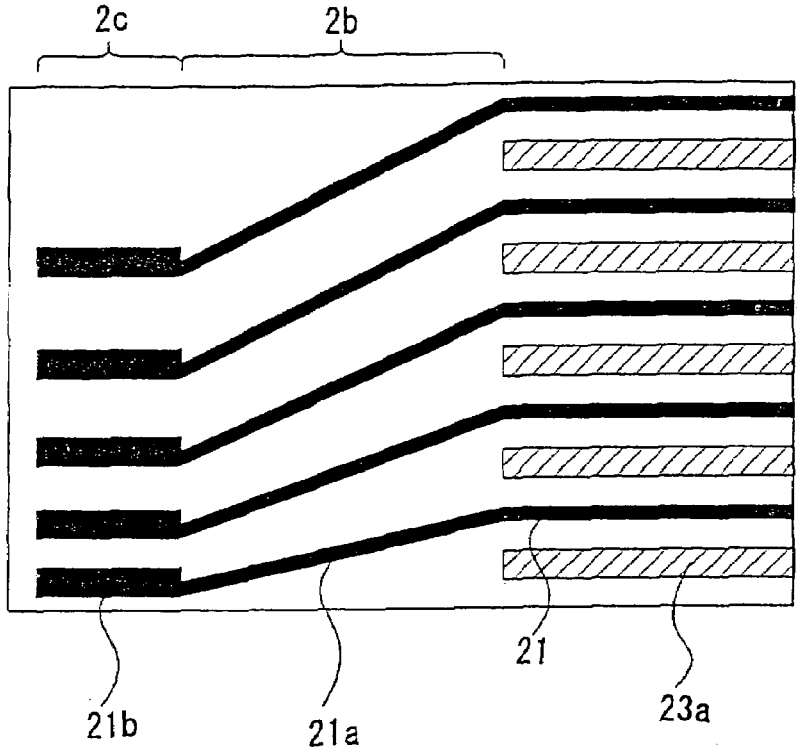
FIGS. 4(A) and 4(B) are a top view and a sectional view of an essential portion of the PDP according to the first embodiment of the present invention, respectively.
Figure 4:
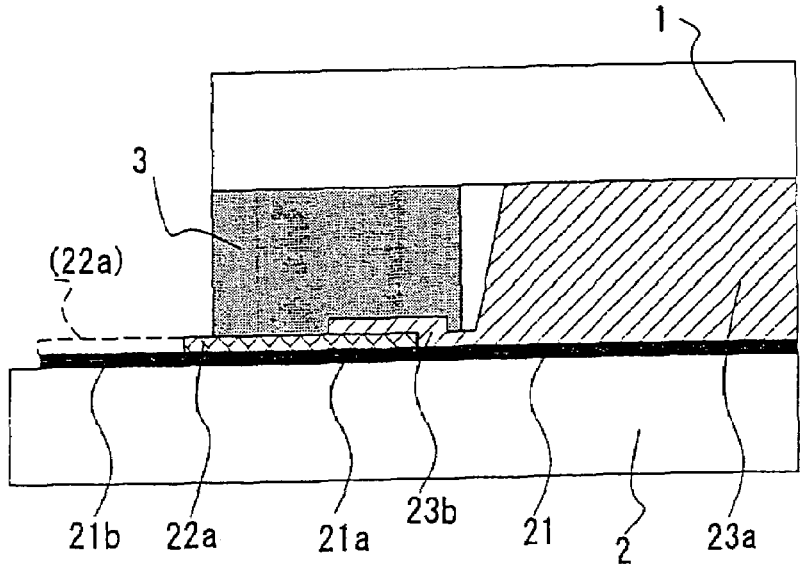

A method of manufacturing a PDP according to a first embodiment of the present invention is explained referring to FIGS. 1–4. FIGS. 1–3 are views for showing the state of a substrate with ribs after the steps of manufacturing the PDP according to the first embodiment. FIG. 4(A) illustrates a top view of an essential portion of the PDP according to the first embodiment and FIG. 4(B) illustrates a sectional view of the essential portion of the PDP according to the first embodiment.

The method of manufacturing the PDP of the first embodiment can be roughly divided into two processes. One process is to form a front panel assembly of the PDP. The other process is to form a rear panel assembly having ribs thereof. Here, explanation of the process of forming the front panel assembly is omitted since the front panel assembly can be formed by a typical technique and the process of forming the rear panel assembly will be described below.

The rear panel assembly of the PDP according to the first embodiment is formed by the successive steps of applying a terminal protective paste 22 on a region in which leads 21*a* and terminals 21*b* are formed on a rear substrate 2 (hereinafter, referred to as a terminal formation region) (Step 1); applying a rib paste 23 on a rib formation region provided on the rear substrate 2 (Step 2); patterning the rib paste 23 into a predetermined shape by use of a mold (Step 3); firing the terminal protective paste 22 and the rib paste (green rib) 23 simultaneously thus having the predetermined shape in order to form a terminal protective layer 22*a* (Step 4); and etching away a portion of the terminal protective layer 22*a* formed on the terminals 21*b* (Step 5).

The terminal protective paste 22 used in Step 1 is composed of a glass paste mainly containing a low-melting glass and an organic binder. The organic binder may be generally a thermosetting binder. For example, cellulosic compounds including ethyl cellulose, methyl cellulose and the like can be used for the organic binder. Additives such as a solvent and a plasticizer may be added into the glass paste. Examples of the solvent include solvents for general purpose use such as terpineol, butyrolactone and toluene. Examples of the plasticizer include dibutyl phthalate, diheptyl phthalate and the like.

Glass frit having the content of 10 to 80 wt % in total of at least one or more lead oxide, bismuth oxide, zinc oxide and phosphorus oxide is used as the low-melting glass contained in the terminal protective paste 22. Adjustment of the total content and ratio of the aforementioned compounds allows controlling of a softening temperature of the low-melting glass. Here, the softening temperature of the low-melting glass contained in the terminal protective paste 22 is set to be lower than that of low-melting glass contained in the rib paste 23 for the following reason. If the low-melting glass contained in the terminal protective paste 22 is higher in softening temperature than that contained in the rib paste 23, the terminal protective paste 22 will not be softened during the simultaneous firing of the terminal protective paste 22 and the rib paste (green rib) 23 in Step 4, and formation of gaps will occur between the terminal protective layer 22*a* and the terminals 21*b* after the firing. Therefore, it is highly probable to cause a leak.

A conventional method of manufacturing a PDP will be explained below with reference to FIGS. 1 to 3. Conventionally, the PDP has been manufactured by firing a terminal protective paste 22 in order to form a terminal protective layer 22*a*, applying a rib paste 23 on the rear substrate 2 having the terminal protective layer 22*a* formed thereon, patterning the rib paste 23 into the predetermined shape by use of a mold, and firing the patterned rib paste 23. Here, the softening temperature of the terminal protective layer 22*a* is set to be higher than that of the rib paste 23 so that the terminal protective layer 22*a* is not softened during the firing performed at the softening temperature of the rib paste (green rib) 23. In this case, however, the firing temperature is not sufficiently high enough to fire the terminal protective layer 22*a*. Consequently, a leak will be caused by the formation of gaps between the terminal protective layer 22*a* and electrodes 21 (including terminals 21*b*). On the other hand, when the firing is performed at the softening temperature of the terminal protective paste 22, the formation of gaps does not occur between the terminal protective layer 22*a* and the terminals 21*b*, but the rib paste (green rib) 23 holding its predetermined shape will be melt and deformed because the firing temperature of the rib paste (green rib) 23 is higher than the softening temperature thereof. Therefore, in the first embodiment, the terminal protective paste 22 is set to be higher in softening temperature than that the rib paste 23.

Further, according to a conventional PDP manufacturing method, the terminal protective paste 22 is applied on the almost entire area of the rear substrate 2 as usual, the rib paste 23 is applied on a rib formation region provided on the rear substrate 2, the rib paste 23 is patterned into the predetermined shape by use of the mold, and both of the terminal protective paste 22 and green ribs (rib paste) 23 are fired at the same time. In this prior art, the terminal protective paste 22 having a lower softening temperature is softened earlier to increase its adhesion to the electrode, thereby preventing the occurrence of leak. However, the softening of terminal protective paste 22 causes filling of grooves between the green ribs (rib paste) 23 and falling down of the green ribs (rib paste) 23. Consequently, it is not possible to form ribs 23*a* with high accuracy.

According to the PDP manufacturing method of the first embodiment, the terminal protective paste 22 is applied in a terminal formation region in Step 1. Accordingly, it is possible to form stable ribs 23*a* because most of the rib paste 23 does not come into contact with the terminal protective paste 22.

The firing in Step 4 can be carried out by either of a batch oven system or conveyor oven system.

Steps 1 to 5 will be sequentially detailed below. In Step 1, on the terminal formation region provided on the rear substrate 2 of FIG. 1(A) and having the electrodes 21, leads 21*a* and terminals 21*b* formed thereon the terminal protective paste 22 is applied by a dispenser, and dried to be cured (see FIG. 1(B)). Thus, in the rear substrate 2, the above terminal formation region is covered with the terminal protective paste 22. Subsequently, in Step 2, the rib paste 23 containing a photo-cure binder is applied on the rib formation region provided on the resulting rear substrate 2 and then semi-dried (see FIG. 2(A)). Here, the rib paste 23 is applied so that its ends overlap with those of terminal protective paste 22, so that the covering of the electrodes is enhanced at a periphery portion of panel assemblies sealed with the sealing material. In Step 3, the rib paste 23 is cured by irradiation of light while a thin plate elastic mold (not shown) with cavities corresponding to a predetermine shape of ribs is pressed against the rear substrate 2 on which the rib paste 23 is applied, and then the mold is released from the rear substrate 2 (see FIG. 2(B)). Subsequently, an excess amount is removed from the rib paste 23 by a development process. In Step 4, the terminal protective paste 22 and rib paste (green rib) 23 are subjected to the firing. In this step, the ribs 23*a* and the dielectric layer for covering the electrodes 21 are formed of the rib paste 23, and the terminal protective layer 22*a* for protecting the leads 21*a* and terminals 21*b* is formed of the terminal protective paste 22. In Step 5, a portion of the terminal protective layer 22*a* covering a terminal portion 2*c* (see FIG. 4(A)) of the rear substrate 2 is removed by an etchant to expose the terminals 21*b* (see FIG. 3). The step 5 is performed after a front substrate 1 formed by another step and the rear substrate 2 are attached together by means of the sealing material 3. Namely, after the ribs 23*a* are formed on the rear substrate 2, each color of the fluorescent pastes having three primary colors is applied into the grooves formed between the ribs and then fired to form fluorescent layers. The attachment of the rear substrate 2 and front substrate 1 is completed by heat-sealing using the sealing material 3 interposed therebetween. The terminal protective layer 22*a* protects the terminals 21*b* from heat obtained by the firing of the fluorescent pastes and by the heat-sealing using the sealing material, thereby preventing oxidization of the terminals 21*b*. FIG. 4(B) illustrates a completed PDP after Step 5.

The PDP manufacturing method of the first embodiment comprises the steps of applying the terminal protective paste 22 lower in softening temperature than the rib paste 23 on the terminal formation region using a dispenser, followed by drying and curing, applying the photo-cure rib paste 23 on the rib formation region, photo-curing the rib paste 23 by pressing the mold against it, pattering it into the predetermined shape, followed by firing the terminal protective paste 22 and rib paste (green rib) 23 at the same time, and etching away the portion of the terminal protective layer 22*a* covering the terminal portion 2*c* in order to expose the terminals 21*b*. In accordance with the present embodiment, since the terminal protective paste 22 is applied only on the predetermined portions of the terminals, the time required for forming the terminal protective layer 22*a* can be significantly reduced. Also, since the terminal protective paste 22 and rib paste (green rib) 23 are fired simultaneously, the time required for firing both of the pastes can be reduced. Therefore, it is possible to manufacture the PDP efficiently.

A Second Embodiment of the Present Invention

A method of manufacturing a PDP according to a second embodiment of the present invention will be explained below. The PDP manufacturing method of the present invention is based on the premise that a molding process is employed. The molding process presents the following problem of the rib formation. Where the rib formation is performed by the molding process according to an ordinary method of manufacturing the PDP, edge portions of the rib paste 23 are spread when the rib paste 23 is patterned into a predetermined shape by pressing the thin plate elastic mold against the paste 23. For this reason, the rib paste 23 spreads to the outside of an appropriate region where ribs are to be formed. Specifically, it may spread over the lead portion 2*b* (see FIG. 4(A)) to the terminal portion 2*c*. Consequently, the rear substrate 2 at the terminal portion 2*c* is provided with a two-layer structure constituted of the terminal protective paste 22 and rib paste 23 and when these pastes 22 and 23 are fired, is provided with a two-layer structure comprising the terminal protective layer 22*a* formed of the terminal protective paste 22 and a dielectric layer 23*b* formed of the rib paste. In such a structure, there is a problem that in addition to the terminal protective layer 22*a*, the dielectric layer 23*b* needs to be etched in spite of the fact that the dielectric layer 23*b* is difficult to etch. In this case, it is possible to improve the accuracy of the rib formation in the molding process so as to allow the rib paste 23 to remain within a roughly predetermined region after the thin plate elastic mold is pressed against it, but this makes it impossible to provide a method of rapidly manufacturing a PDP as the purpose of the present invention.

Figure 5:
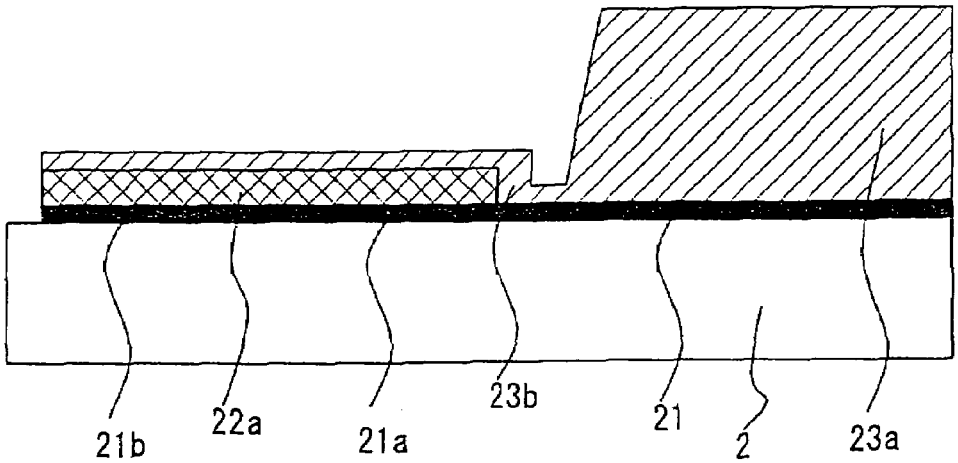
FIGS. 5(A) and 5(B) are sectional views of an essential portion of a PDP according to a second embodiment of the present invention.
Figure 5:
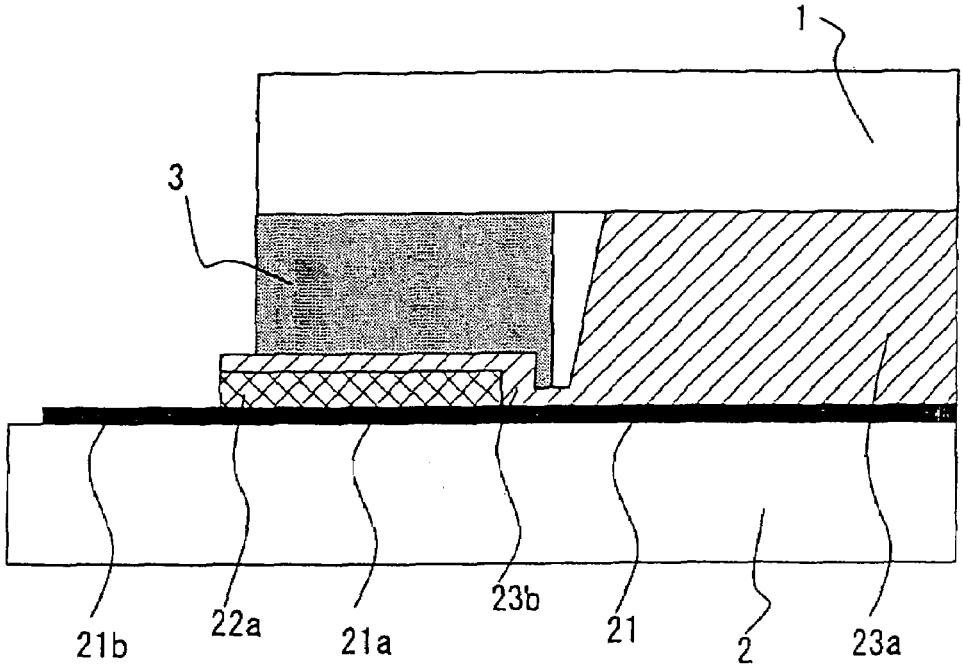
Figure 6:
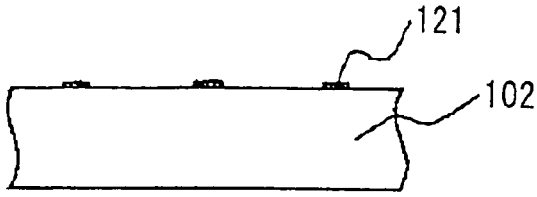
FIGS. 6(*a*) to 6(*e*) are views for illustrating the states of a substrate with ribs after the steps of manufacturing a conventional PDP.
Figure 6:
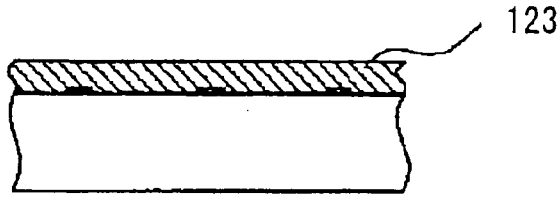
Figure 6:
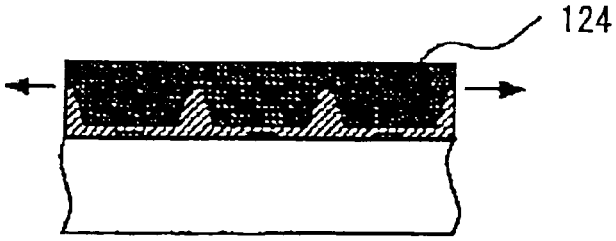
Figure 6:
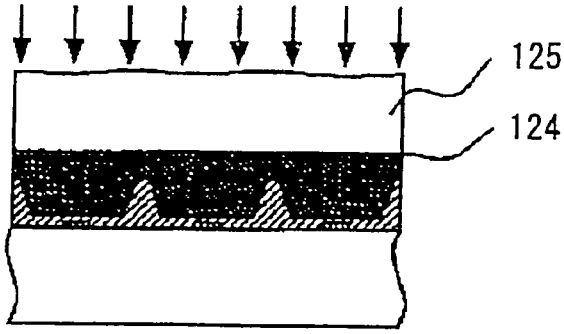
Figure 6:
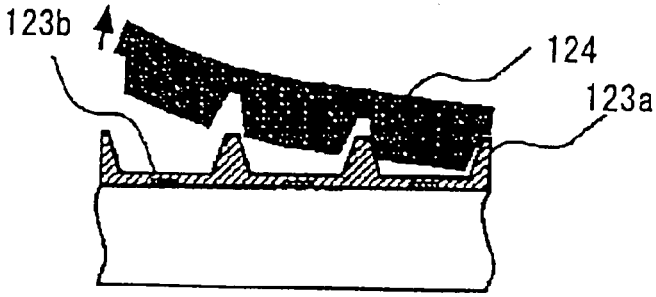

Hereinafter, in order to deal with the above etching problem, the PDP manufacturing method according to the second embodiment of the present invention will be explained with reference to FIGS. 5(A) and 5(B). FIGS. 5(A) and 5(B) show sectional views of essential portions of the PDP according to the second embodiment.

The PDP manufacturing method of the second embodiment is performed in substantially the same manner as in the first embodiment, except that in Step 1, the terminal protective paste 22 is applied so that the terminal protective layer 22*a* formed in Step 5 is formed thicker than the dielectric layer 23*b*.

Acid such as dilute nitric acid having an appropriate temperature may be used as the etchant in Step 5. The amount of filler such as an alumina filler contained in the terminal protective paste 22 is reduced according to the amount of acid desirably to 10 wt % or less. Thus, when the terminal protective layer 22*a* containing a small amount of filler is used, etching of the layer is easily performed by use of the dilute nitric acid.

Steps 1 to 5 will be sequentially detailed below. In Step 1, the terminal protective paste 22 is applied on the lead portion 2*b* and terminal portion 2*c* arranged on the rear substrate 2 by the dispenser so as to be thicker than the protective paste of the first embodiment and then dried to be cured. Thus, in the rear substrate 2, the leads 21*a* and terminals 21*b* are covered with the terminal protective paste 22. In Step 2, the photo-cure rib paste is applied on the rib formation region provided on the resulting rear substrate 2. Subsequently, in Step 3, the thin plate elastic mold of the predetermined shape is pressed against the rib paste 23 applied on the rear substrate 2, so that the rib paste 23 constituting the dielectric layer 23*b* is thinner than the terminal protective paste 22 applied in Step 1. The rib paste 23 is cured by the irradiation of light while it is pressed with the predetermined pressure and the mold is released from the rear substrate 2 (see FIG. 5(A)). The detailed explanations of Steps 4 and 5 are omitted because Steps 4 and 5 are the same as those of the first embodiment. FIG. 5(B) shows the sectional view of the essential portion of the PDP after the terminal protective layer 22*a* and the dielectric layer 23*b* are etched.

According to the PDP manufacturing method of the second embodiment, on the rear substrate 2 on which the electrodes 21, leads 21*a* and terminals 21*b* are formed the terminal protective paste 22 is applied and then dried. The rib paste 23 is applied on the rear substrate 2 and the thin plate elastic mold of the predetermined shape is pressed against the rib paste 23, so that the rib paste 23 serving as the dielectric layer 23*b* is thinner than the terminal protective paste 22. That is, according to the present embodiment, the terminal protective layer 22*a* is formed thicker than the dielectric layer 23*b* after the firing. Also, acid such as dilute nitric acid of an appropriate temperature is used as the etchant and further the terminal protective layer 22*a* contains only a small amount of filler. For these reasons, the portion of the terminal protective layer 22*a* is easily removed away by the etching. In accordance with the removal of the protective layer 22*a*, it is possible to remove a portion of the dielectric layer 23*b* applied on the protective layer 22*a* without performing any processes directly on the dielectric layer 23*b*.

A Third Embodiment of the Present Invention

A PDP manufacturing method according to a third embodiment of the present invention is performed in substantially the same manner as in the first and second embodiments, except that a photo-cure organic binder is used as an organic binder for the terminal protective paste 22 and the protective paste 22 is cured by the irradiation of light.

When the thermosetting organic binder is used as the organic binder, the terminal protective paste needs to be dried after it is applied. In general, the drying is performed by heating the substrate up to a temperature of approximately 100–200° C., but this substrate temperature needs to be lowered after the drying. If the formation of ribs is performed without lowering the substrate temperature, the substrate will be shrunk at about 7 ppm/° C. and the accuracy of the ribs will be deteriorated. For these reasons, the lowering of substrate temperature is performed in order to keep the accuracy of the rib formation above a predetermined level. Consequently, the formation of ribs takes much longer time because of the time required for lowering the substrate temperature. Therefore, the photo-cure organic binder is more preferable than the thermosetting organic binder.

The PDP manufacturing method of the third embodiment is the same as that of the first and second embodiments, except that in Step 1, the terminal protective paste 22 is cured by the irradiation of light after it is applied.

According to the PDP manufacturing method of the third embodiment, since the photo-cure organic binder is used for the terminal protective paste 22 instead of the thermosetting organic binder, there is no loss of time for lowering the substrate temperature raised by drying the terminal protective paste 22 applied on the rear substrate 2 on which the electrodes 21 are arranged. Accordingly, it is possible to go on the next step continuously after the terminal protective paste 22 is cured by the irradiation of light, so that the manufacturing of PDP can be performed rapidly.

The Other Embodiments

According to the PDP manufacturing method of the third embodiment, the photo-cure terminal protective paste 22 and the photo-cure rib paste 23 are used. The terminal protective paste 22 is applied and irradiated with light in Step 1 and the rib paste 23 in Steps 2 and 3. However, the terminal protective paste 22 may be only applied in Step 1, the rib paste 23 may be applied in Step 2 and finally, both of the pastes 23 and 22 may be simultaneously subjected to the irradiation of light in Step 3. Thus, the irradiation time can be reduced much shorter than the case where the rib paste 23 and terminal protective paste 22 are separately irradiated with light.

In view of the foregoing of the present invention, after at least the terminals of electrodes are covered by applying the terminal protective paste thereon and a display region (also referred to as the rib formation region) is fully covered by applying the rib paste thereon, in short, after the terminal protective paste and rib paste cover the electrodes and terminals evenly, both of the protective paste and rib paste (green rib) are fired simultaneously. Thus, the terminal protective paste covers portions of the electrodes which are not covered with the rib paste, and that is, the rib paste and terminal protective paste cover all the portions of the electrodes. Therefore, the electrodes and terminals can be sintered without causing thermal oxidization thereof while the rib paste and a phosphor paste are fired and the periphery of panel assemblies is sealed. Also, the time required for forming the terminal protective paste and rib paste can be reduced.

Also, in accordance with the present invention, since the application of the rib paste is carried out so that the ends of the rib paste overlap with those of the terminal protective paste, the terminals arranged in the seal formation region are covered with the terminal protective paste, which provides a good adhesion between the electrodes (including the terminals) and the terminal protective layer although the gaps are formed due to a poor adhesion of the rib paste for dividing a discharge space to the electrodes. Accordingly, no gaps will be formed therebetween. Thus, it is possible to manufacture the PDP in which the leak hardly occurs after the periphery of the panel assemblies is sealed with the sealing material.

Further, in accordance with the present invention, since the softening temperature of the glass contained in the terminal protective paste is lower than that of the glass contained in the rib paste, the rib paste is sintered during the simultaneous firing of the terminal protective paste and rib paste (green rib), and the protective paste containing the glass lower in softening temperature is softened. Accordingly, the adhesion of the protective paste to the electrodes is increased more and thereby the formation of gaps hardly occurs between the terminal protective layer and the electrodes. Therefore, according to the present invention, the PDP can be manufactured in which almost no leak occurs after the periphery of the panel assemblies is sealed with the sealing material.

Since the terminal protective paste containing the photo-cure binder is used in the present invention, there is no need to dry the protective paste after the application thereof and to lower the substrate temperature raised by the drying, as required in the thermosetting binder. Therefore, the formation of ribs can be smoothly performed.

Additionally, in accordance with the present invention, since the terminal protective paste and rib paste each containing the photo-cure binder are used, there is no need to dry the terminal protective layer after the application thereof and to lower the substrate temperature raised by the drying, as required in the thermosetting binder. Also, the terminal protective paste and rib paste can be simultaneously irradiated with light, thereby making it possible to cure both of the pastes efficiently. Further, since the terminal protective paste and rib paste can be cured at room temperature and the dimensional increase of the substrate can be avoided, the formation of ribs can be performed smoothly.

Further, since the terminal protective paste is thicker than the rib paste according to the present invention, a portion of the terminal protective layer covering more than half of a terminal portion can be etched away during the etching for exposing the terminals, and further a portion of the dielectric layer along with the terminal protective layer can easily be removed away without performing any particular processes on the dielectric layer. Furthermore, when the softening temperature of the terminal protective paste is lower than that of the rib paste, the rib paste is melted into the protective paste and then solidified during the firing, so that the adhesion between the terminal protective layer and the dielectric layer will be increased. Accordingly, this good adhesion allows more easy etching.

Furthermore, in the present invention, since the terminal protective layer is removed by the etching after the sealing of the periphery of the panel assemblies, the terminals can be protected by the terminal protective layer during the sealing. Also, the terminal protective layer can easily be etched by use of acid for exposing the terminals since the terminal protective layer does not contain a large amount of substances which are hardly dissolved in acid and thus is different from the rib paste in which the amount of such substances is small. Further, when the softening temperature of the terminal protective paste is lower than that of the rib paste, the rib paste is melted into the protective paste and then solidified during the firing, so that the adhesion between the terminal protective layer and a dielectric layer which is made of the rib paste will be increased. As a result, in the present invention, it is possible to etch an area of two-layer structure consisting of the terminal protective layer and the dielectric layer more easily.

What is claimed is:

1. A method of manufacturing a plasma display panel having a pair of substrates opposed to each other to define a gas discharge space therebetween, at least one of the substrates having thereon a plurality of electrodes and a dielectric layer covering the electrodes, each electrode having a terminal and a lead extending to the terminal, the terminal and the lead being disposed on a peripheral region of said at least one of the substrates, the method comprising:

forming a terminal protective layer of a predetermined thickness on the peripheral region including the terminals and the leads so that the peripheral region is covered with the terminal protective layer;

forming the dielectric layer on the electrodes in overlapping relation with the terminal protective layer, the dielectric layer being thinner than the terminal protective layer;

sealing peripheries of the pair of substrates in a region where the terminal protective layer is formed, by using a sealing material;

removing, by etching, the terminal protective layer and the dielectric layer outside the sealing material to expose the terminals of the electrodes.

2. The method of claim 1, wherein the forming of the terminal protective layer comprises applying a low-melting glass paste on the peripheral region, and firing the low-melting glass paste.

3. The method of claim 1, wherein the plasma display panel has ribs for partitioning the gas discharge space, and the forming of the dielectric layer comprises:

applying a low-melting glass paste containing a filler with a thickness corresponding to that of the ribs; and molding the low-melting glass paste by use of a stamping die having cavities in the form of a rib shape to form projections as green ribs and a flat portion as the dielectric layer.

4. The method of claim 1, wherein the sealing material is placed in a region where the dielectric layer overlaps with the terminal protective layer, the dielectric layer not directly contacting the electrodes.

5. The method of claim 2, wherein the sealing material is placed in a region where the dielectric layer overlaps with the terminal protective layer, the dielectric layer not directly contacting the electrodes.

6. The method of claim 3, wherein the sealing material is placed in a region where the dielectric layer overlaps with the terminal protective layer, the dielectric layer not directly contacting the electrodes.

7. A method of manufacturing a panel assembly for a plasma display panel having electrodes and ribs formed on a substrate comprising:

forming the electrodes on the substrate so that these electrodes are extended to a periphery of the substrate to form their terminals;

applying a terminal protective paste on the terminals for protecting the terminals;

applying a rib paste on the entire area of a rib formation region provided on the substrate;

molding the rib paste, by use of a stamping die having cavities in the form of a rib shape, into projections as green ribs and a flat portion as a dielectric layer; and firing the terminal protective paste and the rib paste simultaneously to form a terminal protective layer and the ribs on the substrate, wherein the applied terminal protective paste is thicker than the flat portion of the rib paste.

8. A plasma display panel having a pair of substrates opposed to each other to seal peripheries thereof by using a sealing material, at least one of the substrates having thereon a plurality of electrodes and a dielectric layer covering the electrodes, each electrode having a terminal and a lead extending to the terminal, the terminal and the lead being disposed on a periphery of said at least one of the substrates, wherein the leads of the respective electrodes in a region where the sealing material is placed are covered with a glass protective layer of a predetermined thickness, the glass protective layer being interposed between the leads of the respective electrodes and the dielectric layer to prevent a leak therebetween, and the dielectric layer is made of a material different from the glass protective layer, the dielectric layer being thinner than the glass protective layer, the dielectric layer overlapping with the glass protective layer.

9. The plasma display panel of claim 8, further comprising ribs for partitioning a gas discharge space enclosed by the sealing material placed between the pair of substrates, wherein the dielectric layer is made of a low-melting glass paste containing a filler, the dielectric layer being formed integrally with the ribs, the dielectric layer extending over the glass protective layer, the glass protective layer being made of a low-melting glass paste containing no filler.

* * * * *